United States Patent [19]

Murakami et al.

[11] Patent Number: 4,682,769

[45] Date of Patent: Jul. 28, 1987

[54] SHEET SUPPLYING APPARATUS

[75] Inventors: Reiji Murakami, Yokohama; Shinichi Hashimoto, Fujisawa; Mamoru Shimono, Yokohama; Fumito Ide, Zama, all of Japan

[73] Assignee: Kabushiki Kaisha Toshiba, Kawasaki, Japan

[21] Appl. No.: 643,275

[22] Filed: Aug. 22, 1984

[30] Foreign Application Priority Data

Aug. 26, 1983 [JP] Japan ..... 58-155753

[51] Int. Cl.[4] ..... B65H 3/06

[52] U.S. Cl. ..... 271/10; 192/48.3; 271/119; 271/242

[58] Field of Search ..... 271/10, 109, 116, 114, 271/126, 264, 242, 119; 192/24, 26, 25, 28, 48.3, 48.1, 89 R

[56] References Cited

U.S. PATENT DOCUMENTS 4,071,295 1/1978 Komori et al. ..... 271/242
4,437,656 3/1984 Onoda et al. ..... 271/119
4,529,188 7/1985 Sturnick ..... 271/119 X
4,579,328 4/1986 Hagihara et al. ..... 271/119

FOREIGN PATENT DOCUMENTS 2055270 6/1971 Fed. Rep. of Germany .
2934954 3/1980 Fed. Rep. of Germany .
153960 12/1980 Japan .
184043 11/1982 Japan ..... 271/119

OTHER PUBLICATIONS

*IBM Technical Disclosure Bulletin*, "Modular Increment Clutch", G. B. OVerton, Jul. 1978, vol. 21, No. 2, pp. 471–472.

*Primary Examiner*—Andres Kashnikow
*Assistant Examiner*—Matthew C. Graham
*Attorney, Agent, or Firm*—Cushman, Darby & Cushman

[57] ABSTRACT

A sheet supplying apparatus supplies sheets one by one from a paper cassette to a sheet feed portion defined between a photosensitive body and a transfer charger in a housing. The sheet is picked up by rotation of a pair of feed rollers. The picked-up sheet is aligned by register rollers. The feed rollers are then driven in synchronism with the operation of the register rollers.

2 Claims, 17 Drawing Figures

SHEET SUPPLYING APPARATUS

BACKGROUND OF THE INVENTION

The present invention relates to a sheet supplying apparatus for supplying sheets to a sheet feed portion and, more particularly, to a sheet supplying apparatus mounted on a copying machine so as to feed a sheet to a transfer portion in the copying machine.

A conventional sheet supplying apparatus has a paper cassette. Sheets set in the paper cassette are taken up one by one, and each sheet is fed to register rollers. The leading end of the sheet abuts against and is aligned by the register rollers. When the sheet is fed to a transfer portion of a photosensitive drum upon rotation of the register rollers, a toner image is transferred to the sheet.

In the conventional sheet supplying apparatus, the paper feed rollers are mounted on a rotating shaft through a one-way clutch. When the sheet is fed upon rotation of the register rollers, the paper feed rollers are engaged with the sheet and is driven thereby. In this manner, the sheet is pulled between the register rollers and the paper feed rollers, so a load is imposed on the register rollers. As a result, the sheet may slip and will not be properly fed.

SUMMARY OF THE INVENTION

The present invention has been made in consideration of the above situation, and has as its object to provide a sheet supplying apparatus which does not cause a slip between register rollers and the sheet, thereby properly supplying the sheet.

According to one aspect of the present invention, there is provided a sheet supplying apparatus for supplying a sheet to a sheet feed portion, comprising sheet storing means for storing sheets to be picked up; pickup means for picking up the sheets from said sheet storing means one by one; register means for aligning a picked-up sheet by said pickup means and supplying the sheet to the sheet feed portion; and driving means for driving said pickup means simultaneously as said register means is driven.

In order to achieve the above object, the sheet supplying apparatus comprises driving means for driving sheet supplying means in synchronism with the operation of register means.

DETAILED DESCRIPTION OF THE PREFERRED EMBODIMENT

Figure 1:
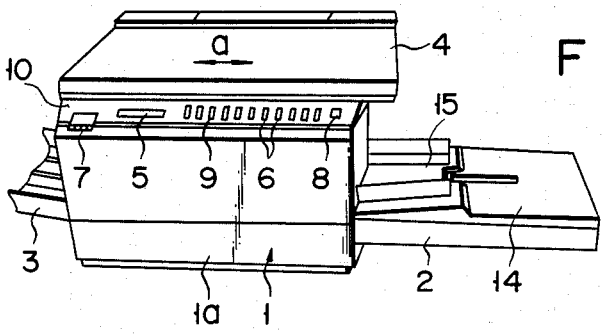
FIG. 1 is a perspective view showing an electronic copying machine to which an embodiment of a sheet supplying apparatus according to the present invention is applied.
Figure 2:
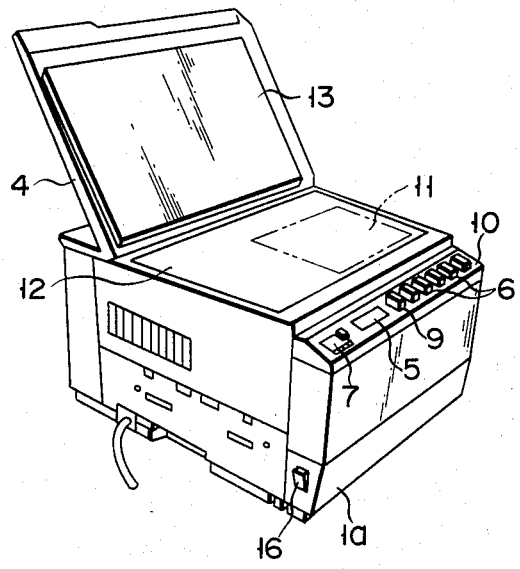
FIG. 2 is a perspective view of the electronic copying machine of FIG. 1 when viewed from a different direction to that of FIG. 1.
Figure 3:
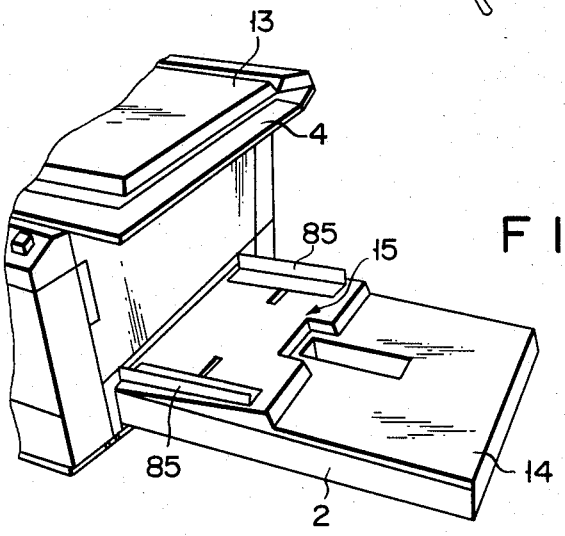
FIG. 3 is an enlarged perspective view showing part of a paper supplying apparatus of FIG. 1.

An electronic copying machine which employs a sheet supplying apparatus according to an embodiment of the present invention will be described with reference to the accompanying drawings. FIGS. 1 to 3 show the outer appearance of the electronic copying machine to which the sheet supplying apparatus according to the present invention is applied. Reference numeral 1 denotes a copying machine housing incorporated with a copying mechanism; 2, a paper cassette attached to the right side portion of the housing 1 so as to hold sheets therein; and 3, a discharge tray attached to the left side portion of the housing 1. A document table 4 is mounted on the upper surface of the housing 1 and can reciprocate along the right-and-left direction (indicated by arrow a). An operation panel 10 having a display unit 5 and input keys 9 (e.g., numerical keys 6, an exposure preset volume 7, and a print key 8) is arranged at the upper front portion of the housing 1.

As shown in FIG. 2, the document table 4 has a document support plate (glass plate) 12 for supporting a document 11 and a document cover 13 for covering the upper surface of the document support plate 12.

A cassette cover 14 on the paper cassette 2 also serves as a manual feed plate 15 for feeding a sheet P′ as needed, as shown in FIG. 3. Referring to FIG. 2, reference numeral 16 denotes a power switch.

Figure 4:
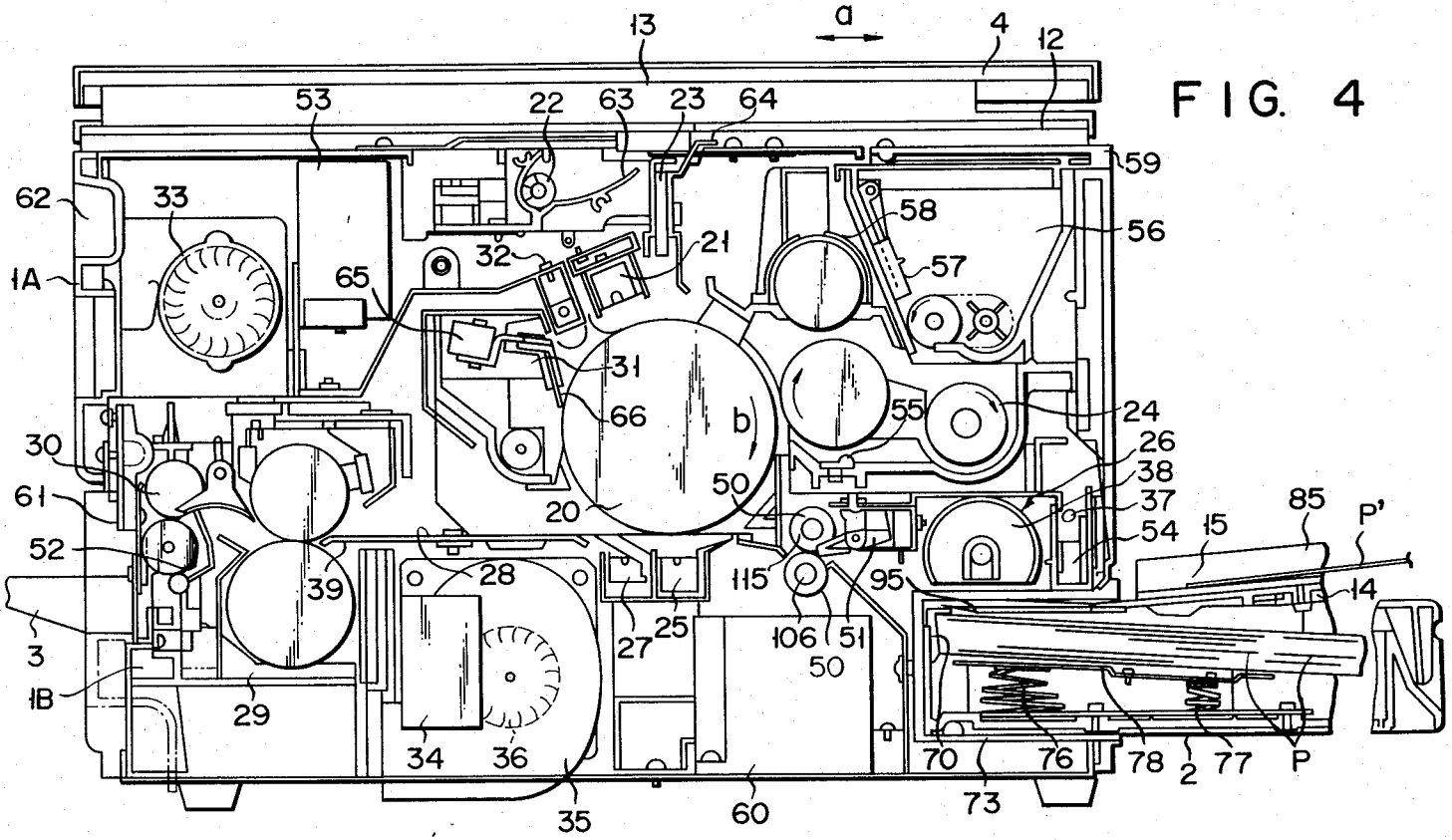
FIG. 4 is a plan view schematically showing the internal configuration of the electronic copying machine shown in FIG. 1.

The internal configuration of the electronic copying machine will be described with reference to FIG. 4. Referring to FIG. 4, reference numeral 20 denotes a photosensitive drum disposed at substantially the center of the housing 1. The photosensitive drum 20 is rotated by a drive mechanism (not shown) in a direction given by arrow b in synchronism with reciprocal movement of the document table 4. The photosensitive drum 20 is uniformly charged by a charger 21. The document is uniformly illuminated by an exposure lamp 22, and light reflected by the document is focused by a converging light transmission member (SELFOC [tradename]lens array) on the photosensitive drum 20, and an electrostatic latent image is formed thereon. The latent image is visualized as a toner image by a developing unit 24. The photosensitive drum 20 is rotated such that this toner image opposes a transfer charger 25.

An automatically or manually fed sheet P or P′ is supplied by a sheet supplying apparatus 26 to a transfer portion defined between the photosensitive drum 20 and the transfer charger 25. The preformed toner image on the photosensitive drum 20 is transferred by the transfer charger 25 at the transfer portion to the sheet P or P′. The transferred sheet P or P′ is separated by a separation charger 27 in accordance with AC corona discharge and is conveyed to a fixing unit 29 through a convey path 28. The toner image is melted and fixed by the fixing unit 29 on the sheet P (or P'). The fixed sheet P (or P') is discharged by a pair of discharge rollers 30 on the detachable tray 3.

On the other hand, after the toner image is transferred to the sheet P (or P'), a residual toner on the photosensitive drum 20 is cleaned by a cleaner 31 and is removed from the surface of the photosensitive drum 20. Thereafter, a surface potential at the photosensitive drum 20 is decreased below a predetermined level, and the copying machine is ready for the next copying operation.

Reference numeral 33 denotes a fan as a cooling unit. The cooling unit discharges heat radiated from heating generating portions which are the exposure lamp 22 and the fixing unit 29. A ventilation fan 36 is arranged for a main motor 35 to cool a power source section 34 and hence the interior of the electronic copying machine.

An upper frame (not shown) and a lower frame (not shown) are arranged inside the housing 1. Each of the upper and lower frames is supported at one end to be pivotal about a shaft 37. The other end of the upper frame can be opened to form a predetermined angle (e.g., 30 degrees) with respect to the corresponding end of the lower frame. The photosensitive drum 20 and its peripheral units such as the charger 21, a converging optical transmission member 23, the exposure lamp 22, the developing unit 24, the cleaner 31 and a discharge lamp 32 are mounted by proper means in the upper frame. The fan 33 as the cooling unit and paper feed rollers 38 of the sheet supplying apparatus 26 and the document table 4 are also mounted in and on the upper frame. The above-mentioned components mounted in and on the upper frame constitute an upper unit 1A. The paper cassette 2, the transfer charger 25, the separation charger 27, the convey path 28, a guide plate 39, the fixing unit 29, the discharge rollers 30, the discharge tray 3, the main motor 35 and the power source section 34 are mounted by proper means in the lower frame so as to constitute a lower unit 1B.

An operator turns a front cover 1*a* of the housing 1 toward himself and opens the upper unit 1A through a housing opening/closing mechanism (not shown) substantially along the convey path 28 of the sheet P (or P'). Therefore, even if the sheet P (or P') is jammed on the convey path 28, the operator can easily remove the jammed sheet.

Reference numerals 50 in FIG. 4 denote a pair of register rollers which are in rolling contact with each other. The register rollers 50 serve as register means to correct a ramp at the leading end of the automatically or manually fed sheet P or P'. The register rollers 50 also serve to supply the sheet P or P' to the transfer portion in synchronism with the toner image forming timing of the photosensitive drum 20. Reference numeral 51 indicates a manual feed detecting switch arranged in front of the register rollers 50.

Reference numeral 52 denotes a discharge switch; 53, a total counter; 54, a paper empty switch for detecting that the sheets P in the paper cassette 2 are empty; 55, a doctor blade for controlling a thickness of a developer layer; 57, a toner empty detecting switch; 58, a toner density sensor; and 59, a hopper cover. When the hopper cover 59 is not closed, the document table 4 will not move. Reference numeral 60 denotes a high-voltage transformer; 61, a discharging brush; 62, a handle for opening/closing the upper unit 1A; 63, a reflector for surrounding the rear portion of the exposure lamp 22; and 64, an auxiliary reflector. Reference numeral 65 denotes a weight for bringing a cleaning blade 66 of the cleaning unit into contact with the photosensitive drum 20 at a predetermined pressure. The blade 66 is brought into contact with or separated from the photosensitive drum 20 by means of a solenoid (not shown).

The reflector 63, the auxiliary reflector 64 and the converging optical transmission member 23 constitute a single unit.

The sheet supplying apparatus 26 disposed at the right lower potion of the housing 1 comprises the paper cassette 2, the manual paper feed plate 15 formed on the cassette cover 14 for covering the surface of the upper surface of the paper cassette 2 which excludes a sheet pickup opening having sheet separating pawls, and the paper feed rollers 38 as sheet supplying means for picking up the sheet P from the paper cassette 2.

Figure 5:
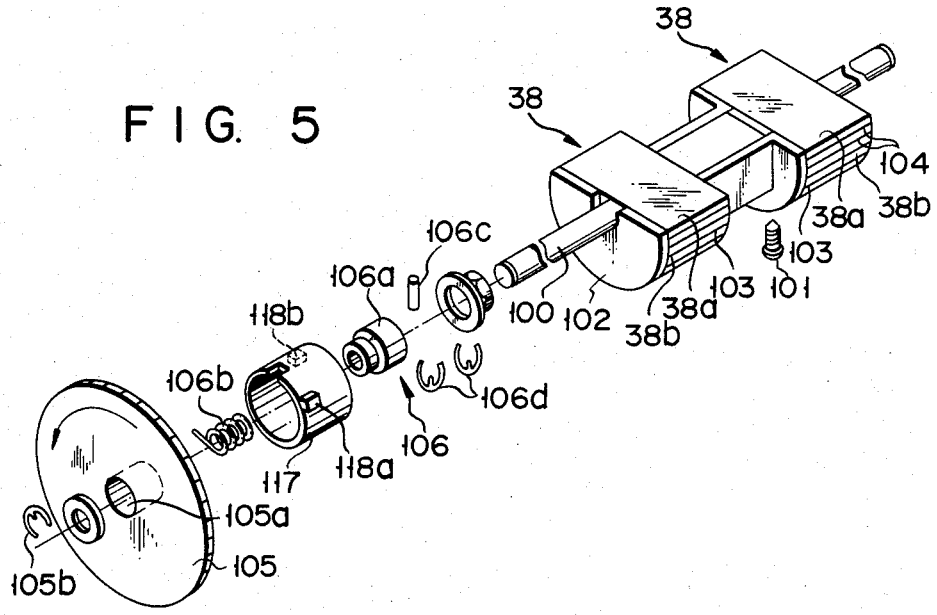
FIG. 5 is an exploded perspective view showing the construction between paper feed rollers and a spring clutch.

Each paper feed roller 38 has a semi-spherical shape, as shown in FIGS. 4 and 5. In other words, the peripheral surface of the paper feed roller 38 comprises a flat surface 38*a* and an arcuated surface 38*b*. When the sheet is not picked up from the paper cassette 2, the flat surface 38*a* as the non-pick-up portion is set along (horizontal direction, i.e., the state shown in FIG. 4) the manual paper feed direction. In this manner, the flat surface 38*a* of the paper feed roller 38 serves as a guide member for guiding the upper surface of the manually fed sheet P'.

As shown in FIG. 5, each paper feed roller 38 is mounted in a holder 102 fixed on a first drive shaft 100 through a set screw 101, and each endless rubber belt 103 is looped around the corresponding paper feed roller 38. A portion of the rubber belt 103 which corresponds to the arcuated surface 38*b* of the corresponding paper feed roller 38 has a plurality of grooves 104 so as to increase a friction coefficient. The grooves 104 are not formed at a portion of the belt 103 which corresponds to the flat surface 38*a* so as to smoothly guide the manually fed sheet P'.

Figure 6:
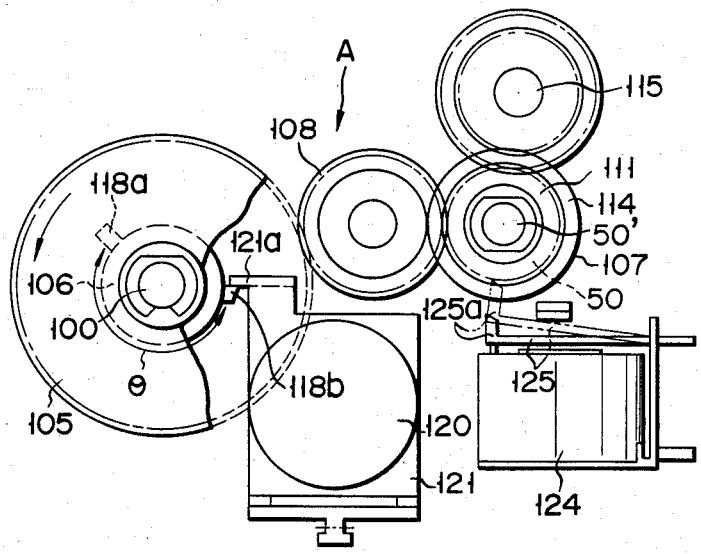
FIG. 6 is a front view showing a drive system for the register rollers and the paper feed rollers.
Figure 7:
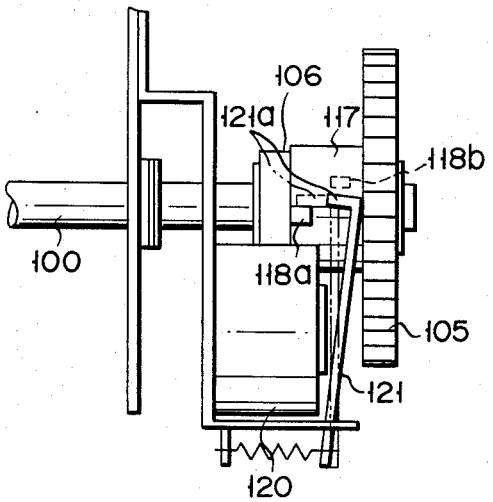
FIG. 7 is a side view of a clutch mechanism for the paper feed roller.
Figure 8:
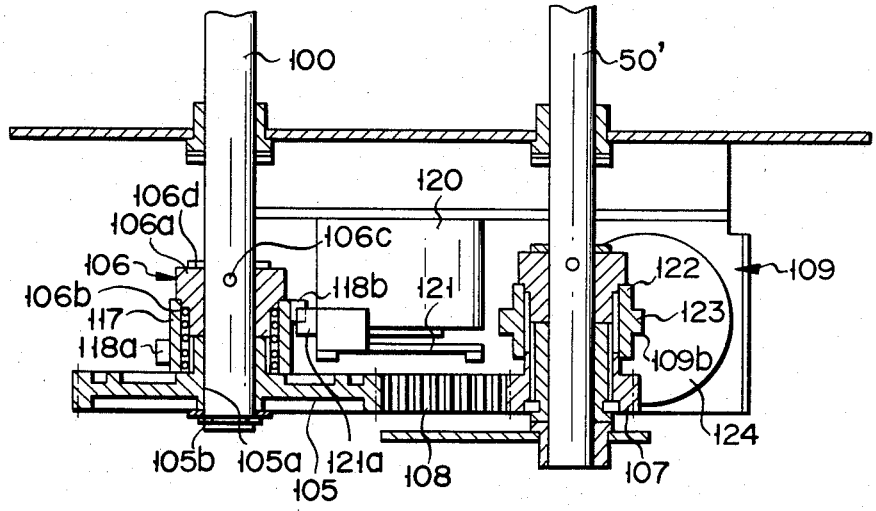
FIG. 8 is a sectional view showing clutch mechanisms for the paper feed rollers and the register rollers.

As shown in FIGS. 6 to 8, a drive gear 105 which constitutes a driving means A together with a drive gear 107 and an intermediate gear 108 (both are described in detail later) is mounted on the first drive shaft 100 through a spring clutch 106. The rotational force of the drive gear 105 is selectively transmitted to the first drive shaft 100 through the spring clutch 106. The drive gear 107 is mounted through a spring clutch 109 on a second drive shaft 50' having the lower register roller 50 thereon. In other words, the rotational force of the drive gear 107 can be selectively transmitted to the second drive shaft 50' through the spring clutch 109. The drive shaft 107 meshes with a drive gear 115, and the driving force of the motor 35 is transmitted to the drive gear 107 through the drive gear 115. The spring clutch 106 for selectively transmitting the driving force of the gear 105 to the drive shaft 100 having the paper feed rollers 38 thereon has a sleeve 117, as shown in FIG. 5. On the outer circumferential surface of the sleeve 117 are provided with two stop projections 118*a* and 118*b*. As shown in FIG. 6, the stop projections 118*a* and 118*b* are separated from each other by a predetermined angle ($\theta = 210$ degrees as shown in FIG. 6) in the circumferential direction. They are also separated from each other in the axial direction by a predetermined distance. A stop lever 121 is disposed in the vicinity of a solenoid 120 to be attracted to or repelled from the solenoid 120 upon the on/off operation thereof. A stop portion 121*a* of the stop lever 121 is selectively engaged with the stop projection 118*a* or 118*b* upon the on/off operation of the solenoid 120. In other words, the paper feed rollers 38 are intermittently rotated in such a manner that when the stop projection 118*a* or 118*b* is engaged with the stop portion 121*a*, the paper feed rollers 38 will not rotate even if the first drive gear 105 is rotated, but that the paper feed rollers 38 are rotated only when the stop projection 118*a* or 118*b* is not engaged with the stop portion 121*a*. Therefore, the paper feed rollers 38 are intermittently driven in this manner.

The spring clutch 109 for transmitting the driving force of the second drive gear 107 to the drive shaft 50' of the register roller 50 has a sleeve 122, as shown in FIG. 8. A ratchet gear 123 is mounted on the sleeve 122. A stop lever 125 is disposed in the vicinity of a solenoid 124 and can be attracted to or repelled from the solenoid upon the on/off operation thereof. A stop portion 125*a* of the stop lever 125 is engaged with or disengaged from the ratchet gear 123 upon the on/off operation of the solenoid 124 irrespective of the position of the ratchet gear 123. In other words, the register rollers 50 are intermittently rotated in such a manner that the register rollers 50 are rotated when the solenoid 124 is energized, but that the register rollers 50 are stopped when the solenoid 124 is deenergized.

The construction of the spring clutch 109 is known to those skilled in the art, and a detailed description thereof will be omitted.

The spring clutch 106 will be slightly described. Referring to FIG. 8, a spring 106*b* is wound around a small-diameter portion of an arbor 106*a*. The sleeve 117 surrounds the spring 106*b* wound around the small-diameter portion. One end of the spring 106*b* is stopped by a groove 117*a* formed in the sleeve 117, and the other end thereof is fixed at the arbor 106*a*. The arbor 106*a* is fixed on the drive shaft 100 by a fastening member such as a pin 106*c* and a ring 106*d*. Unless the stop projection 118*a* or 118*b* of the sleeve 117 is stopped by the stop lever 121, the spring 106*b* is fastened around the arbor 106*a* by the rotational force of the drive gear 105, so that the driving force of the drive gear 105 is transmitted to the drive shaft 100.

The control operation will now be described with reference to FIGS. 9 to 15. FIG. 9 is a block diagram of the electronic copying machine which employs the sheet supplying apparatus according to an embodiment of the present invention. Reference numerals 58, 150, 52, 51, 54, 151 and 152 denote switches, respectively. Various data are supplied to a microprocessor 154 through a data selector 153. Reference numeral 58 denotes a sensor for detecting a density of a toner in a developing unit; 150, a switch for detecting that the recovered toner particles are full in a toner recovery bag; 52, a switch for checking that the sheet is discharged from the convey path; 51, a switch for detecting that the manually fed sheet P' is inserted in a position at the pair of resist rollers 50; 54, a switch for detecting that the sheets becomes empty in the paper cassette 2; 151, a switch for detecting a document table position; and 152, a switch for presetting an operating mode of the copying machine. Reference numeral 9 denotes input keys. The input keys 9 include the print switch for starting copying operation, the numerical keys for preseting the number of sheets to be copied, a clear/stop key for correcting a numerical key input or stopping the copying operation, and an exposure control volume. The input data from the input keys 9 is supplied to the microprocessor 154 through the data selector 153. At the same time, a key input scan signal is supplied from the microprocessor 154 to the input keys 9. Reference numeral 155 denotes a reset circuit. The reset circuit 155 supplies a reset signal and a clock signal to the microproccessor 154.

The microprocessor 154 supplies a signal to the display unit through a driver 156 so as to display necessary information. At the same time, the microprocessor 154 supplies a dynamic lighting scan signal to the display unit 5.

On the other hand, various control signals from the microprocessor 154 are supplied through the driver 157 to a heater control circuit 158, a lamp control circuit 159, a driver 160, high-voltage power sources 161 and 162, a document table clutch 163, the paper feed roller solenoid 120, a register roller solenoid 124, a toner replenishing solenoid 164, a cleaner blade solenoid 65 and the counter 53.

The heater control circuit 158 controls energization of a fixing heater 165 and controls a temperature thereof at a possible fixing temperature. The lamp control cricuit 159 controls energization of the expose lamp 22. The driver 160 controls the on/off operations of the main motor 35 and the discharge lamp 32. The high-voltage power source 161 applies proper voltages to the transfer charger 25, the separation charger 27 and a developing bias circuit 166 in response to the control signals. The high-voltage power source 161 applies a high voltage to the charger 21. The document table clutch 163 selectively transmits the driving force for reciprocaing the document table. The paper feed roller solenoid 120 and the register roller solenoid 124 start/-stop the spring clutches between the drive source and the rollers 38 and between the drive source and the rollers 50 so as to start/stop the rollers 38 and 50, respectively. The toner replenishing solenoid 164 is started when the toner density detector 58 detects that the toner density is less than a preset vlaue and replenishes the developing unit with a toner from the toner hopper.

The solenoid 65 for the cleaning blade urges the cleaning blade 66 toward the photosensitive drum 20 or separates the blade 66 from the drum 20. The counter 53 counts the number of copied sheets. The fan 33 is used to cool the interior of the electronic copying machine.

A signal representing a temperature of the fixing heater 165 is supplied from the heater control circuit 158 to the microprocessor 154 through the data selector 153.

Figure 9A:
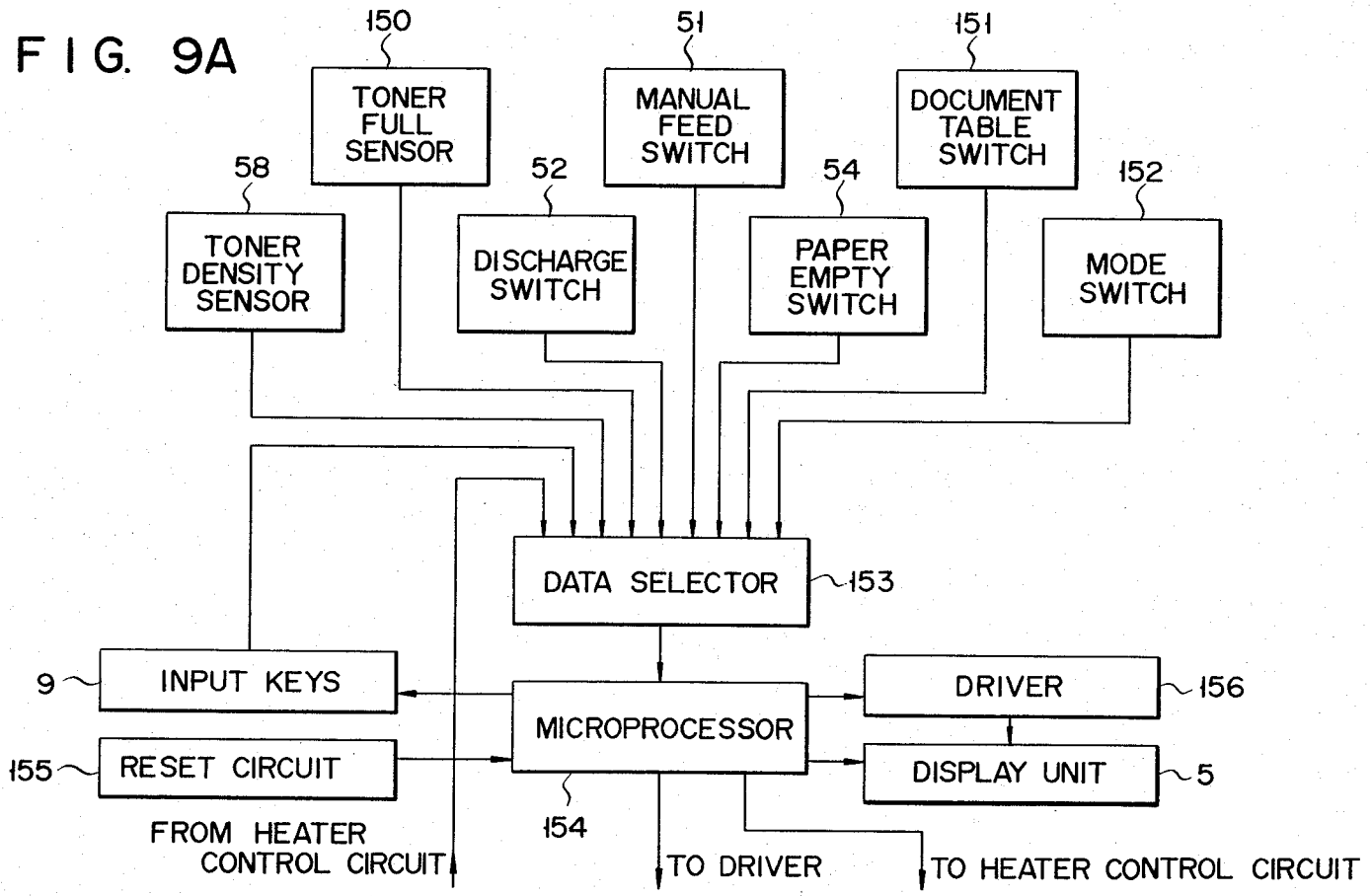
FIGS. 9A and 9B are block diagrams showing a control system of the electronic copying machine shown in FIG. 1.
Figure 9B:
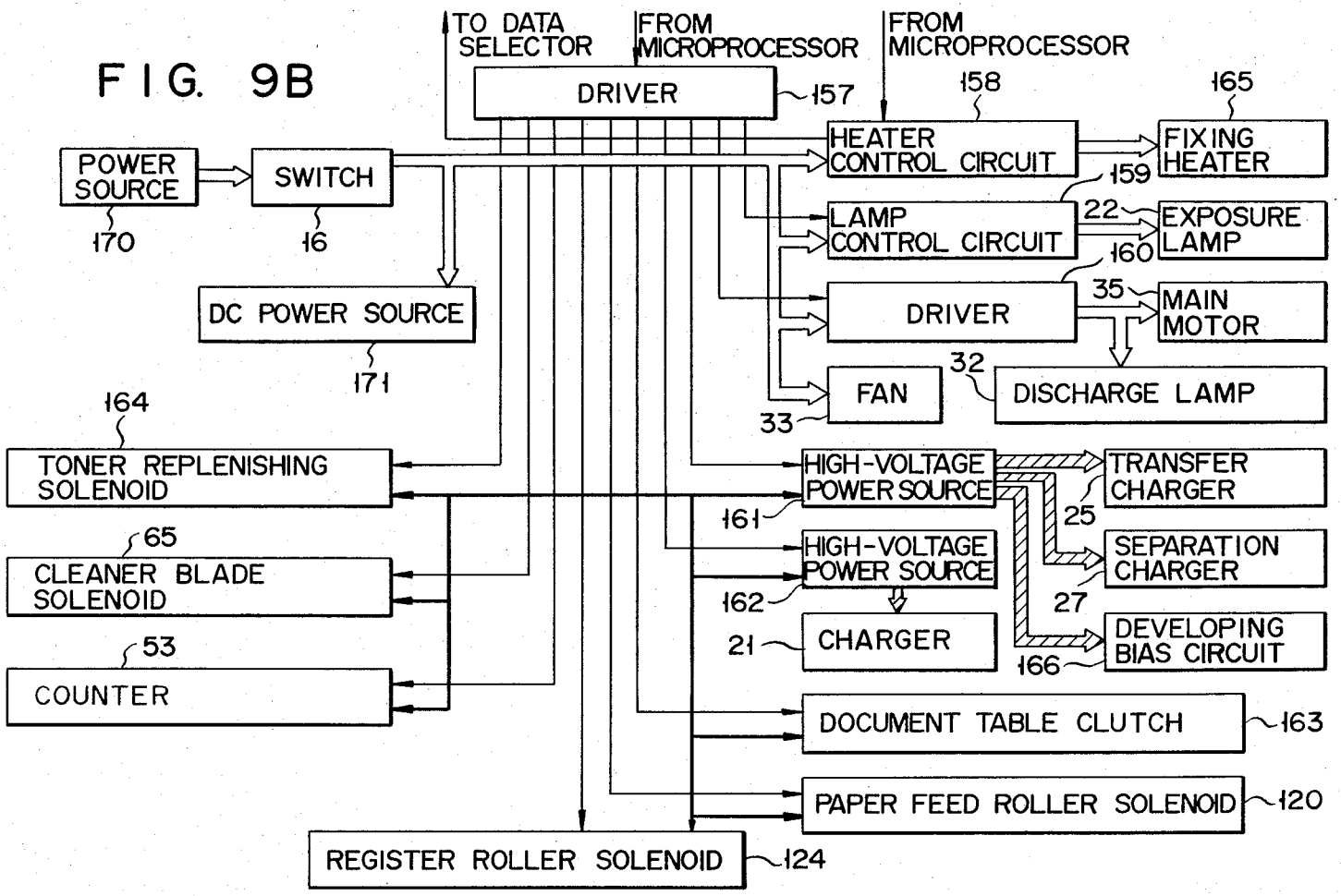

Reference numeral 170 denotes a main power source which is connected to a DC power source 171 or the like through the switch 16. Referring to FIGS. 9A and 9B, symbol "→" indicates a signal flow; "→", an AC voltage flow; "→", a DC voltage flow; and "→", a high voltage flow.

FIGS. 10 to 13 show the arrangement of the document table switch 151. A document table limit detection magnet 200, a document table home position detection magnet 201, a paper start position detecting magnet 202, and document table start position detecting magnets 203 and 204 are arranged on the lower surface of the document table 4 which excludes an area corresponding to the glass plate 12.

Figure 10:
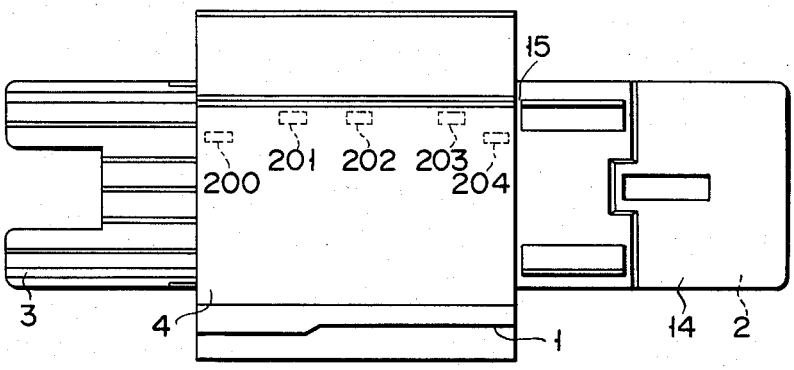
FIG. 10 is a plan view showing a mounting state of document table switches.

The magnets 201 to 203 are linearly aligned in the vicinity of the rear edge of the glass plate 12. The magnets 200 and 204 are linearly aligned in front of the array of the magnets 201 to 203 (FIG. 10). These magnets 200 to 204 cause lead switches 205 and 206 to turn on when lead switches 205 and 206 are come close to them.

Figure 11:
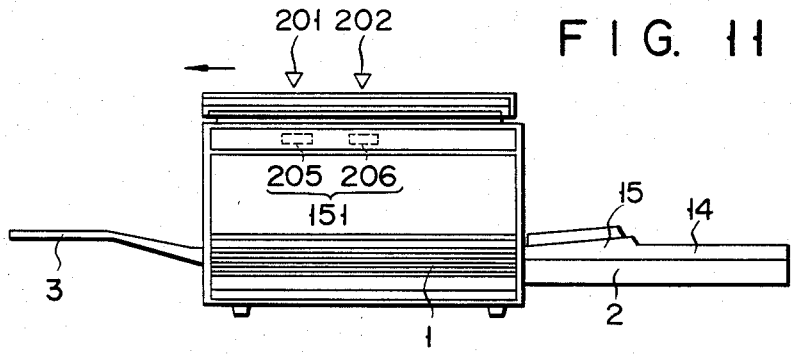
FIGS. 11 to 13 are plan views showing the different operating states of the document table, respectively.

These lead switches 205 and 206 constitute the document table switch 151. FIG. 11 shows a state wherein the document table 4 is held in the home position. The document table 4 is set in this initial position every time the copying operation is completed. In the home position, the magnet 201 causes the lead switch 205 to turn on. The positions of the respective magnets in FIGS. 11 to 13 are indicated by triangle marks, respectively.

Figure 12:
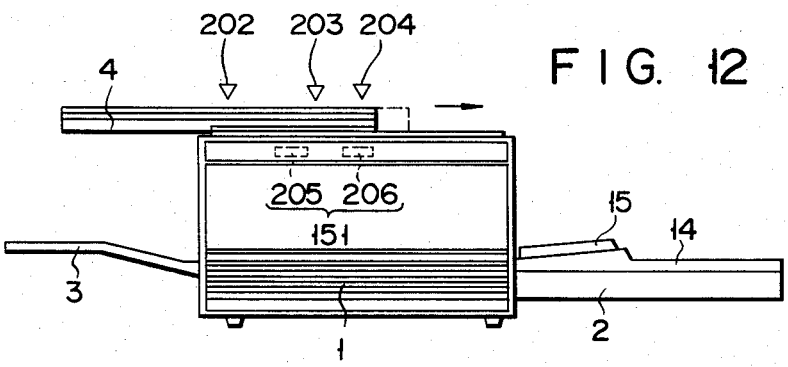

FIG. 12 shows a state wherein the document table 4 is located at the start position. In this start position, the document table start position detection magnets 203 and 204 cause the lead switches 205 and 206 to turn on, thereby properly detecting the start position. In this state, the exposure operation of the document 11 is started, and the document table 4 is moved along a direction indicated by an arrow in FIG. 12. The start of the document table movement is detected when the switch 205 is turned on by the magnet 202. A detection signal from the switch 205 is supplied to the microprocessor 154 to start the register roller solenoid 124. The register rollers 50 are then rotated, and the sheet P is fed to the transfer portion.

Figure 13:
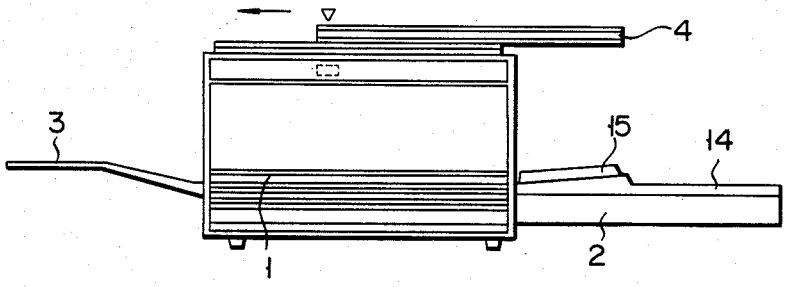

When the document table 4 is further moved and the state shown in FIG. 13 is obtained, the magnet 200 causes the lead switch 206 to turn on, so that the limit position of the document table 4 is checked. The document table 4 is moved back in a direction indicated by an arrow in FIG. 13 and restores the state shown in FIG. 11.

The positions of the document table 4 are detected in response to the lead switches 205 and 206 (151 in FIG. 9A), and the microprocessor 154 selectively operates the document table clutch 163 so as to reciprocate the document table 4 and stop it at a predetermined position.

Figure 14:
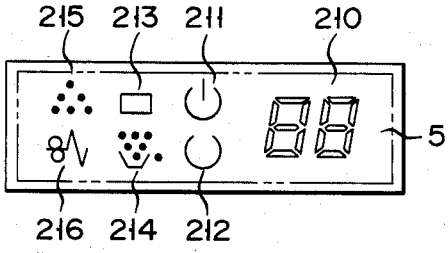
FIG. 14 is a plan view showing a display unit.

FIG. 14 shows the display unit 5. Reference numeral 210 denotes an element for displaying the number of sheets to be copied; 211, an element representing a wait state (copy disable state); 212, an element representing a ready state (copy enable state); 213, an element representing a paper empty state; 214, an element representing that the recovered toner particles are full in the toner recovery bag; 215, an element representing that the toner in the toner hopper becomes empty; and 216, an element representing a paper jam.

The display element 210 normally displays the number of copies (a preset copy number entered by the numerical keys, and the remaining number of sheets to be copied). When an operating mode is set by the mode switch 152, the element 210 also displays a number representing the operating mode. In addition, when paper jamming occurs, the element 210 displays a numeric value representing a jammed paper position.

The mode switch 152 can be set by the operator in any one of the normal mode, the aging mode, the check mode and the forced ready mode. The normal mode is the normal copying mode. When the aging mode is set, the element 210 displays characters "AC". In the aging mode, the normal copying operation is repeated excluding the sheet supplying operation, thereby performing aging of the electronic copying machine. The aging mode can be cancelled by the clear/stop key. When the check mode is set, the element 210 displays characters "CH". In this mode, various input data entered through the data selector 153 are checked to perform display (by light-emitting diodes) in accordance with the input states, and the output states of the output ports of the microprocessor 154 are checked. The check mode is cancelled by the clear/stop key. When the forced ready mode is set, the ready display is performed until the fixing heater 165 is heated at a fixing temperature. The control of these modes is performed in accordance with the program stored in the memory in the microprocessor 154.

When the operator depresses the power switch 16, power is supplied from the power source 170 to the respective components. The microprocessor 154 reads data from the respective switches through the data selector 153. The microprocessor then detects that no failure occurs and performs operation in accordance with a preset mode by the mode switch 152.

Figure 15A:
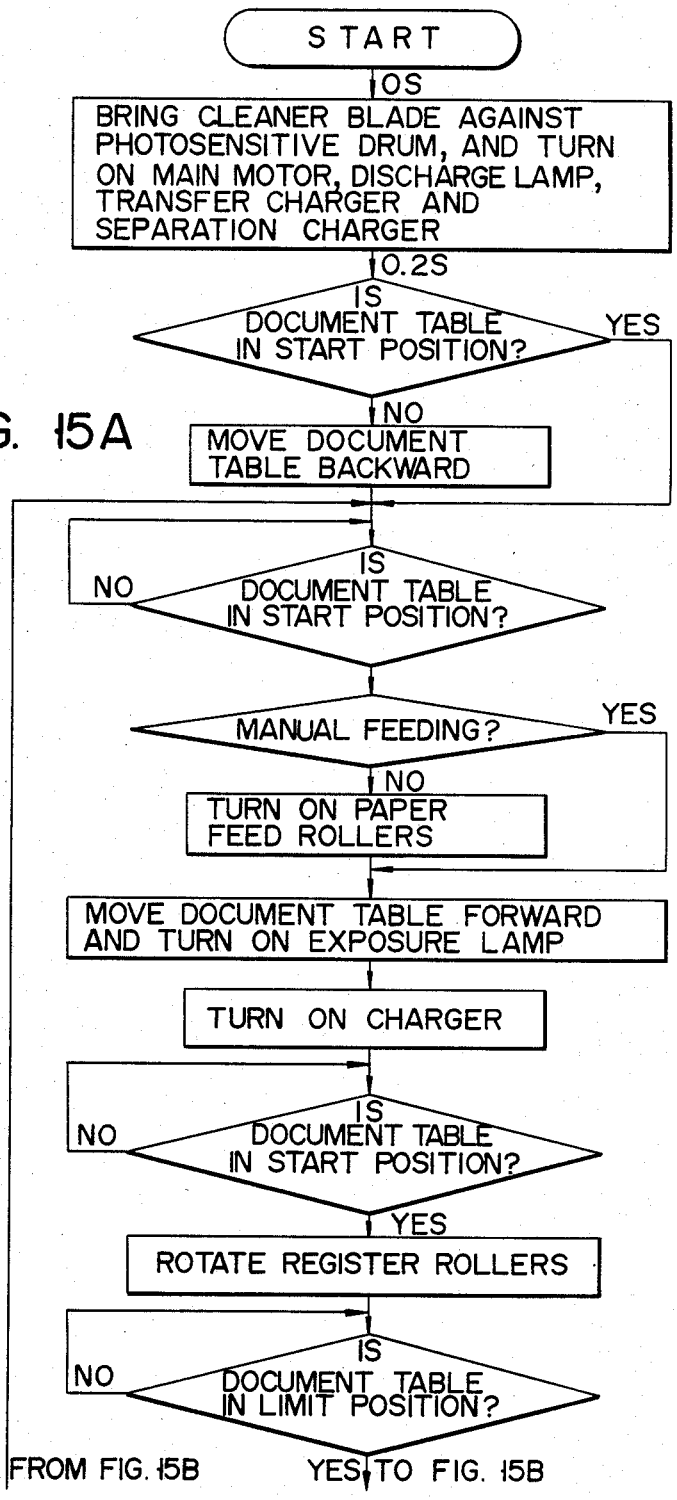
FIGS. 15A and 15B are flow charts for explaining the operation of the electronic copying machine shown in FIG. 1.
Figure 15B:
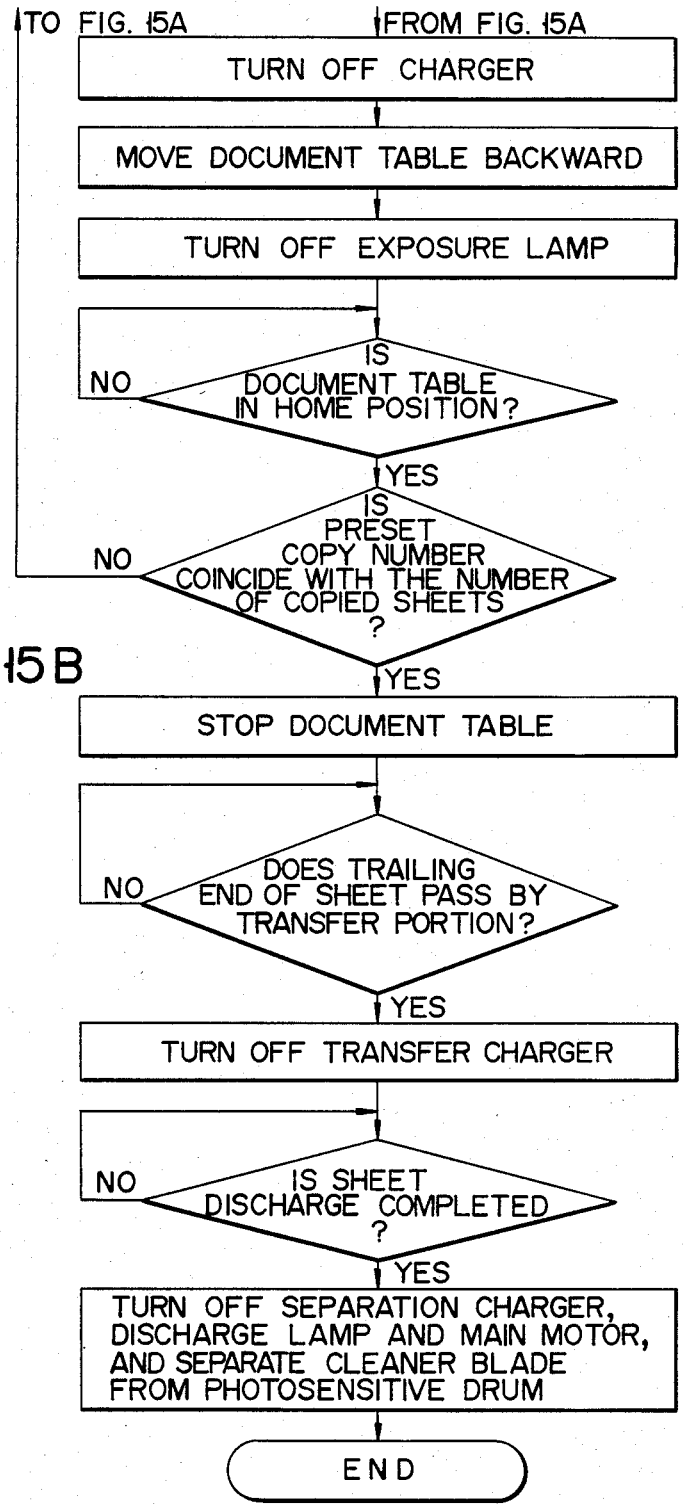

The normal mode will be described with reference to a flow chart of FIG. 15. When the microprocessor 154 does not detect any failure, the element 211 of the display unit 5 is turned on. The microprocessor 154 waits for the signal representing the fixing temperature supplied from the heater control circuit 158. When this signal is supplied to the microprocessor 154 through the data selector 153, the element 211 is turned off, and the element 212 is turned on.

When the preset copy number data is entered by the input keys 9, the preset copy number is displayed on the element 210. When the operator depresses the copy switch, the copying operation is started.

The microprocessor 154 causes the driver 157 to drive a cleaner blade solenoid (not shown) to urge the cleaning blade 66 against the photosensitive drum 20. The microprocessor 154 also causes the driver 160 to start the main motor 35 and the discharge lamp 32, thereby rotating the photosensitive drum 20. In addition, the microprocessor 154 drives the high-voltage power source 161 to apply a voltage to the transfer charger 25 and the separation charger 27.

The microprocessor 154 receives data from the document table switch 151 through the data selector 153 and checks whether or not the document table 4 is set in the start position. When the microprocessor 154 detects that the document table 4 is not located at the start position, the microprocessor 154 causes the document table clutch 163 to return the document table 4 to the start position. The microprocessor 154 then causes the paper feed roller solenoid 120 to rotate the paper feed rollers 38 at a predetermined speed. When the sheet P is automatically picked up from the paper cassette 2, the exposure lamp 22 is turned on.

The document table 4 is then moved from the start position, and exposure is started. The high-voltage power source 161 is driven to apply a voltage to the charger 21. When the document table 4 continues to reciprocate, and the microprocessor 154 detects in response to the signal from the document table switch 163 that the document table 4 is located at the paper start position, the microprocessor 154 causes the driver 157 to energize the register roller solenoid 124 and the paper feed roller solenoid 120 to simultaneously rotate the register rollers 50 and the paper feed rollers 38. As a result, the sheet P is fed to the transfer portion. When the microprocessor 154 detects in response to the signal from the document table switch 163 that the document table 4 is located at the limit position, the microprocessor 154 controls the power source 162 to stop the charger 21 and drive the document table clutch 163, thereby returning the document table 4 to the home position. The microprocessor 154 also controls the lamp control circuit 159 to turn off the exposure lamp 22.

The microprocessor 154 then detects that the document table 4 is located in the home position in response to the signal from the document table switch 151. The microprocessor 154 checks whether or not the number of copied sheets is the same as the preset copy number. When the microprocessor 154 detects that a coincidence between the number of copied sheets and the preset copy number is not obtained, the above operation is repeated.

When the copying cycle is completed, the document table 4 returns to the home position and stops thereat. When a signal from the manual feed switch 51 representing that the sheet P' has passed the transfer portion is received by the microprocessor 154 through the data selector 153, the microprocessor 154 controls the high-voltage power source 161 to stop the transfer charger 25.

When the microprocessor 154 receives a discharge signal from the discharge switch 52, the microprocessor 154 detects that the paper discharge is completed. The microprocessor 154 then controls the high-voltage power source 161 and the driver 160 to stop the separation charger 27, the discharge lamp 32 and the main motor 35. Thereafter, the microprocessor 154 controls the cleaner blade solenoid (not shown) to separate the blade 66 from the drum 20, thereby completing the copying operation.

The operations of the respective components will be additionally described. When the power source switch 16 is turned on, the blade solenoid (not shown) of the cleaner 31 is turned on, and the blade 66 is brought into tight contact with the drum 20. The main motor 35, the discharge lamp 32, the transfer and separation chargers 25 and 27 are turned on for about seven seconds (corresponding to three revolutions of the photosensitive drum 20) so as to keep the potential at the photosensitive drum 20 constant and to uniformly discharge the photosensitive drum 20. When the thermister detects that a heat roller temperature of the fixing unit 29 has reached 109° C., the copy ready sign is turned on. When the operator depresses the print key 8, the blade solenoid (not shown), the main motor 35 and the transfer and separation chargers 25 and 27 are turned on. When a period of about 0.5 second has elapsed after the blade solenoid is turned on, the document table clutch 163 is driven to move the document table 4 from the home position (center) to the start position. In this case, when the document table 4 does not return to the start position within three seconds after the clutch solenoid is turned on, an error code "EZ" representing the document table lock state is displayed on the display unit 5, so that the operator can know the failure. However, when the microprocessor 154 detects that the document table 4 has reached the start position, the document table solenoid is deenergized, and the paper feed roller solenoid 120 is in turn energized, thereby rotating the paper feed rollers 38 so as to start automatic cassette paper feeding.

The paper feed or sheet supplying timing from the paper cassette 2 will be described in detail.

(1) The register rollers 50 and the paper feed rollers 38 are stopped when the microprocessor 154 waits for the copy start instruction.

(2) The paper feed roller solenoid 120 is turned on when the copy start instruction is supplied to the microprocessor 154. The paper feed rollers 38 are rotated through about 210° (the sheet is not fed through the first 60° due to the presence of the flat surfaces 38*a* of the paper feed rollers 38) until the second stop projection 118*b* is disengaged from the stop portion 121*a* and the first stop projection 118*a* is engaged with the stop portion 121*a*. In this manner, the sheet P is picked up from the paper cassette 2 and is fed until it temporarily abuts against the register rollers 50 which are not rotated.

(3) The register roller solenoid 124 is turned on in response to a register roller start signal generated in synchronism with the signal from the document table 4, and the stop portion 125*a* of the stop lever 125 is engaged with the ratchet gear 123. As a result, the register rollers 50 are rotated. At the same time, the paper feed roller solenoid 120 is turned off. The paper feed rollers 38 are rotated through about 150° until the first stop projection 118*a* is disengaged from the stop portion 121*a* and the second stop projection 118*b* is engaged with the stop portion 121*a*. Thus, the paper feed rollers 38 return to the initial position.

(4) When a period of about 100 msec has elapsed after the sheet P passes by the manual feed switch 51 arranged at a position in front of the register rollers 50 by about 5 mm, the register roller solenoid 124 is turned off to disengage the ratchet gear 123 from the stop portion 125*a*, thereby stopping rotation of the register rollers 50.

(5) When the sheet P does not pass by the manual feed switch 51 in front of the register rollers 50 even if the paper feed signal is supplied to the microprocessor 154 in the continuous copying mode, the paper feed roller solenoid 120 is turned on to rotate the paper feed rollers 38. Thereafter, procedures (1) to (5) are repeated. When the previous sheet P is left in procedure (5), the paper feed and register rollers 38 and 50 are simultaneously rotated for 100 msec. However, the sheet is not fed while the paper feed rollers 38 are rotated through the first 60° . Therefore, paper feed is stopped after the register rollers 50 are stopped. When a margin of 300 msec is considered to cause the paper feed rollers 38 to idle, the register rollers 50 are stopped until the sheet P has reached the register rollers 50. When the register rollers are normally operated in the continuous copying mode, the register rollers 50 are properly stopped before the paper feed signal is supplied. When the register rollers are not stopped, the sheet P has a length exceeding a normal length.

A series of timing control operations described above are performed in accordance with the program stored in the microprocessor 154 shown in FIG. 9.

The leading end of the sheet P is clamped between the nip portions which is the location where the rollers touch of the register rollers 50 when the sheet is fed from the paper cassette 2. The paper feed rollers 38 are temporarily stopped while the sheet P is warped by rotation of the paper feed rollers 38. Thereafter, the register rollers 50 are rotated at a predetermined timing. When the register rollers 50 are rotated, the paper feed rollers 38 are simultaneously rotated to return to the stop position. In other words, the drive gear 105 of the paper feed rollers 38 is rotated through the intermediate gear 108 while the register rollers 50 are being rotated. On the other hand, the paper feed roller solenoid 120 is turned off, and the paper feed rollers 38 are rotated in synchronism with the register rollers 50, so that the paper feed rollers 38 restore the initial state.

Conventionally, when the sheet is fed by the register rollers 50, the paper feed rollers 38 are driven upon engagement between the sheet P and the paper feed rollers 38. For this reason, the register rollers 50 are loaded, and the sheet P slips between the register rollers 50. However, according to the embodiment of the present invention, the register rollers 50 and the paper feed rollers 38 are simultaneously rotated. For this reason, even if the sheet is in contact with the paper feed rollers 38, a load is not imposed on the register rollers 50. In addition, when the paper feed rollers 38 return to the initial positions, no load is imposed on the register rollers 50, thereby completely eliminating slipping between the sheet and the register rollers.

On the other hand, when the sheet is manually fed, the operator inserts the sheet P' from the manual paper feed plate 15 integrally formed with the cassette cover 14, so that the distal end of the sheet P' directly abuts against the register rollers 50. Thereafter, when the operator depresses the print key 8 to start the copying operation, the manual feed switch 51 arranged in front of the register rollers 50 detects that the sheet is the manually fed sheet P'. In this case, even if the printing operation is started, the paper feed rollers 38 will not rotate. When the copy start instruction is supplied to the microcomputer 154, the register rollers 50 are rotated at a predetermined timing.

When the document table 4 returns to the document table start position, the paper feed roller solenoid is turned on. When a period of 0.04 second has elapsed, the exposure lamp 22 is turned on. When a period of 0.16 second has elapsed, the document table solenoid is turned on to move the document table 4 from the start position, thereby starting the exposure process of the photosensitive drum 20. In addition, when a period of 0.13 second has elapsed, the charger 21 is turned on. When the document table 4 is located in the start position, the register roller solenoid 124 is turned on, and the register rollers 50 are rotated at a timing at which the leading end of the document is synchronized with that of the sheet P'. The register rollers 50 are stopped when a predetermined period of time has elapsed after the manual feed switch 51 detects the trailing end of the sheet P'. The register rollers 50 then wait for the next sheet P (P').

Thereafter, the document table 4 is returned to the central home position. The sheet P' having a toner image transferred by the transfer charger 25 is fixed by the fixing unit 29 and is discharged by the discharge rollers 30 on the tray 3. The main motor 35 is rotated for about 1.15 seconds after the discharge switch 52 is turned off. The main motor 35 is then stopped Subsequently, the cleaning blade 66 is separated from the photosensitive drum 20.

As has been apparent from the description of the embodiment above, the driving mechanism is arranged to simultaneously drive the register rollers and the paper feed rollers. Unlike the conventional apparatus, the paper feed rollers will not serve as a load of the register rollers, thereby properly feeding the sheet.

What is claimed is:

1. A sheet supplying apparatus for supplying a sheet from a stored location, comprising:

sheet storing means for storing sheets;

pickup means for picking up sheets from said sheet storing means one by one, said pickup means including a substantially semi-cylindrical pickup roller which is rotatable about a fixed axis and which has a contact surface which contacts a sheet to be picked up and a flat noncontact surface as a part of a peripheral surface thereof, said flat surface being smaller in area than an area of a plane passing through the center of the pickup roller;

register means for aligning the sheet picked up by said pickup roller and for supplying the picked up sheet to the sheet feed location, said register means including a pair of rotatable register rollers which contact each other at a nip portion thereof;

guide means for guiding the picked up sheet along said flat surface of the pickup roller into said nip portion between the register rollers; and driving means for: first, rotating only said pickup roller to pick up the sheet and to transport the sheet to a location where the leading edge of the picked up sheets abuts against the nip portion of said register rollers, next, stopping the rotation of the pickup roller while keeping the trailing edge of the sheet engaged with said pickup roller thereby ensuring that alignment of the sheet is maintained, and next rotating simultaneously the pickup roller and at least one of the register rollers to supply the aligned sheet to the sheet feed portion;

wherein said driving means includes:

a first drive shaft on which said pickup member is mounted, said first drive shaft being arranged to rotatably support said pickup member;

a first drive gear mounted on said first drive shaft;

first clutch means, arranged between said first drive shaft and said first drive gear, for controlling transmission of a driving force from said first drive gear to said first drive shaft;

a second drive shaft on which one of said pair of register rollers is mounted, said second drive shaft being arranged to rotatably support said one of said pair of register rollers;

a second drive gear mounted on said second drive shaft;

second clutch means, arranged between said second drive shaft and said second drive gear, for controlling transmission of a driving force from said second drive gear to said second drive shaft;

connecting means for connecting said first drive gear and said second gear so as to transmit the driving force therebetween;

a drive source for driving at least one of said first drive gear and said second drive gear;

first controlling means for controlling a timing of transmission of the driving force by said first clutch means; and second controlling means for controlling a timing of transmission of the driving force by said second clutch means; and wherein said first clutch means includes:

an arbor fitted and fixed around said first drive shaft;

a spring wound around said arbor and having one end fixed on said arbor; and a sleeve formed to surround said spring, said sleeve being fixed on said first drive gear, the other end of said spring being stopped by said sleeve wherein said sleeve has said first and second engaging projections which are spaced apart from each other at a predetermined angular interval along a circumferential direction thereof, and said first clutch means does not transmit the driving force from said first drive gear to said first drive shaft when a first or second engaging projection is stopped, and said first clutch means transmits the driving force when said first or second engaging projection is not stopped, and wherein said first controlling means includes:

a solenoid; and a swingable stop lever, disposed in a vicinity of said solenoid, for engaging with said first engaging projection when said solenoid is energized to attract the stop lever and engaging with said second engaging projection when said solenoid is deenergized.

2. An apparatus according to claim 1, wherein said first and second engaging projections are formed on said sleeve and are spaced apart from each other at a predetermined distance in an axial direction thereof, and said stop lever is movable in the axial direction of said sleeve.

* * * * *